US009574330B2

(12) United States Patent
Plouzek

(10) Patent No.: US 9,574,330 B2
(45) Date of Patent: Feb. 21, 2017

(54) RETENTION SYSTEM FOR A WEAR MEMBER

(71) Applicant: Caterpillar Inc., Peoria, IL (US)

(72) Inventor: John Michael Plouzek, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/818,380

(22) Filed: Aug. 5, 2015

(65) Prior Publication Data

US 2016/0040400 A1 Feb. 11, 2016

Related U.S. Application Data

(60) Provisional application No. 62/035,100, filed on Aug. 8, 2014.

(51) Int. Cl.
*E02F 9/28* (2006.01)

(52) U.S. Cl.
CPC ..... *E02F 9/2883* (2013.01); *E02F 9/2816* (2013.01)

(58) Field of Classification Search
CPC ..... E02F 9/2883; E02F 9/2825; E02F 9/2808; E02F 9/2841; E02F 9/2858; E02F 9/2816
USPC ..... 37/446, 452–460; 403/150, 153, 297, 403/355; 172/701.1–701.3
See application file for complete search history.

(56) References Cited

U.S. PATENT DOCUMENTS

| | | | | |
|---|---|---|---|---|
| 5,333,696 | A | 8/1994 | Cornelius | |
| 5,452,529 | A | 9/1995 | Neuenfeldt et al. | |
| 5,564,508 | A | 10/1996 | Renski | |
| 6,052,927 | A | 4/2000 | Pippins | |
| 6,374,521 | B1 | 4/2002 | Pippins | |
| 7,275,338 | B2 | 10/2007 | LaHood | |
| 8,468,724 | B2 | 6/2013 | Leslie et al. | |
| 8,468,725 | B2 | 6/2013 | Leslie et al. | |
| 9,009,995 | B2 * | 4/2015 | Freund | E02F 9/2883 37/452 |
| 2009/0205228 | A1 | 8/2009 | Ruvang | |
| 2009/0304442 | A1 | 12/2009 | Dennis et al. | |

FOREIGN PATENT DOCUMENTS

| | | |
|---|---|---|
| WO | 2011134014 | 11/2011 |

* cited by examiner

*Primary Examiner* — Robert Pezzuto
(74) *Attorney, Agent, or Firm* — Finnegan, Henderson, Farabow, Garrett & Dunner, LLP

(57) ABSTRACT

A retention system for a wear member may have a flange having a mounting slot defined between a first inner wall and a second inner wall, which are parallel to an axis. The retention system may also have a first retention member having a first through hole, and a second retention member having a second through hole. The retention system may additionally have a fastener configured to be received in the first and second through holes. The fastener may be configured to move the first retention member and the second retention member in opposite directions along the axis. The retention system may be configured such that movement of the retention members along the axis exerts forces on the first and second inner walls perpendicular to the axis.

17 Claims, 7 Drawing Sheets

RETENTION SYSTEM FOR A WEAR MEMBER

RELATED APPLICATION

This application is based on and claims priority to U.S. Provisional Application No. 62/035,100 filed on Aug. 8, 2014, the contents of which are expressly incorporated herein by reference.

TECHNICAL FIELD

The present disclosure is directed to a retention system, and more particularly, to a retention system for a wear member.

BACKGROUND

Earth-working machines, such as, for example, excavators, wheel loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications.

To protect these implements against wear, and thereby prolong the useful life of the implements, various ground engaging tools, such as teeth, edge protectors, and other wear members, can be provided to the earth-working implements in the areas where the most damaging abrasions and impacts occur. These ground engaging tools are removably attached to the implements using retention systems, so that worn or damaged ground engaging tools can be readily removed and replaced with new ground engaging tools.

One such retention system is disclosed in U.S. Pat. No. 5,333,696 that issued to Cornelius on Aug. 2, 1994 ("the '696 patent"). The '696 patent discloses a protector for a work tool that includes a pair of openings that align with a transverse hole in the work tool. A pin is inserted through the aligned holes to retain the protector in place on the work tool.

The retention system of the '696 patent may have some drawbacks. For example, the retention system requires a hole in the work tool, which may negatively affect the strength of the work tool. In addition, this type of retention system may limit a wear member to being installed at only one position on the work tool (i.e., the position where the openings in the wear member align with the hole in the work tool). The transverse pin does not allow relative movement (e.g., pull-back movement onto the work tool) during installation, since the holes must be aligned before the pin can be inserted. Relative movement, such as, pull-back movement during installation, may allow a wear member to adapt to various sizes and shapes of work tools, such as those caused by wear over time, manufacturing tolerances, etc.

Further, while some current wear member retention systems may allow for pull-back movement during installation, they may also be less than optimal. In one example, a threaded retention bolt may be threadably inserted through a portion of a wear member and through a member attached to a work tool. The retention bolt may be aligned parallel to a side surface of the work tool and perpendicular to a protected edge of the work tool, such that tightening of the retention bolt may cause the wear member to pull back onto the protected edge. While this type of retention system may allow relative movement during installation, it may also be susceptible to a few problems. In particular, alignment of the retention bolt to be perpendicular to the protected edge may more easily allow the retention bolt to work loose during operation. Force applied against the protected edge tends to release tension on the retention bolt, allowing the retention bolt to work loose. Therefore, this type of retention system may not be ideal for holding a wear member tightly in place over the useful lifetime of the wear member. In addition, retention bolts in general are often uncovered on an exterior of a wear member, and are thus exposed to damage during use.

The present disclosure is directed to overcoming one or more of the problems set forth above and/or other problems of the prior art.

SUMMARY

In one aspect, the present disclosure is directed to a retention system for a wear member. The retention system may include a flange configured to be attached to the wear member. The flange may include a recessed mounting slot defined between a first inner wall and a second inner wall, which are parallel to an axis. The retention system may also include a first retention member that includes a first surface and a first through hole, and a second retention member that includes a second surface and a second through hole. The retention system may additionally include a fastener that includes a first section configured to be received in the first through hole and a second section configured to be received in the second through hole. The fastener may be configured to move the first retention member and the second retention member in opposite directions along the axis. The retention system may be configured such that movement of the first retention member and the second retention member in opposite directions along the axis causes the first surface and the second surface to exert a retaining force on the first inner wall in a direction perpendicular to the axis.

In another aspect, the present disclosure is directed to a wear member assembly for a work tool. The wear member assembly may include a wear member that includes a protecting portion configured to protect an edge of the work tool, and a mounting portion configured to secure the wear member to a surface of the work tool, the mounting portion including a mounting slot defined between a first inner wall and a second inner wall which are parallel to an axis. The wear member assembly may further include a retention mechanism configured to secure the mounting portion to the surface of the work tool. The retention mechanism may include a retention member including a first surface and a first through hole, and a fastener including a first section configured to be received in the first through hole, and configured to move the first retention member along the axis. The retention mechanism may be configured such that movement of the first retention member along the axis causes the first surface to exert a retaining force on the first inner wall in a direction perpendicular to the axis.

In yet another aspect, the present disclosure is directed to a work tool assembly. The work tool assembly may include a work tool including a side surface that extends to a side edge and a mounting boss secured to the side surface. The mounting boss may include a first surface. The work tool assembly may further include a wear member configured to be installed on the work tool. The wear member may include a protecting portion configured to protect the edge of the work tool, and a mounting portion configured to secure the wear member to the side surface of the work tool, the mounting portion including a recessed mounting slot defined between a first inner wall and a second inner wall which are parallel to an axis. The work tool assembly may further include a retention mechanism configured to secure the mounting portion to the side surface of the work tool. The retention mechanism may include a first retention member including a second surface and a first through hole, a second retention member including a third surface and a second through hole, and a fastener including a first section configured to be received in the first through hole and a second section configured to be received in the second through hole, and configured to move the first retention member and the second retention member in opposite directions along the axis. The retention mechanism may be configured such that movement of the first retention member and the second retention member in opposite directions along the axis causes the second surface and the third surface to exert a retaining force on the first inner wall in a direction perpendicular to the axis, and the first surface to exert a retaining force on the second inner wall in an opposite direction perpendicular to the axis.

DETAILED DESCRIPTION

Figure 1:
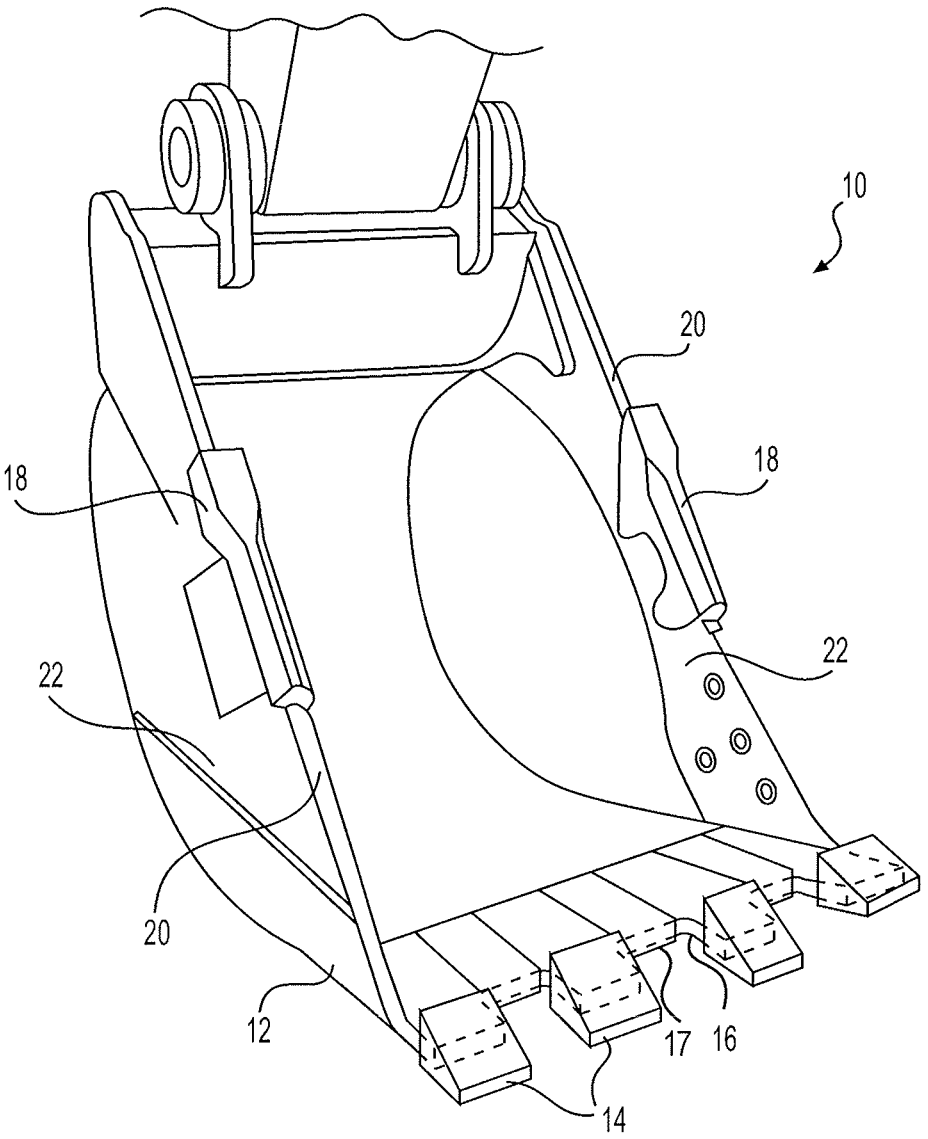
FIG. 1 is an illustration of an exemplary work tool.

FIG. 1 illustrates an excavator bucket assembly 10 as an exemplary implement of an earth-working machine. Excavator bucket assembly 10 includes a bucket 12 used for excavating work material in a known manner. Bucket 12 may include a variety of ground engaging tools. For example, bucket 12 may include a plurality of tooth assemblies 14 attached to a base edge 16 of bucket 12, a plurality of base edge protectors 17 attached to base edge 16, and a plurality of side edge protectors 18 attached to side edges 20 and/or side surfaces 22 of bucket 12.

Side edge protectors 18 may be replaceable wear members configured to protect side edges 20 of bucket 12. Side edge protectors 18 may be secured to bucket 12 by retention systems according to the present disclosure. While various embodiments of the present disclosure will be described in connection with a particular ground engaging tool (e.g., side edge protector 18), it should be understood that the present disclosure may be applied to, or used in connection with, any other type of ground engaging tools or components (e.g., tooth assembly 14).

Figure 3:
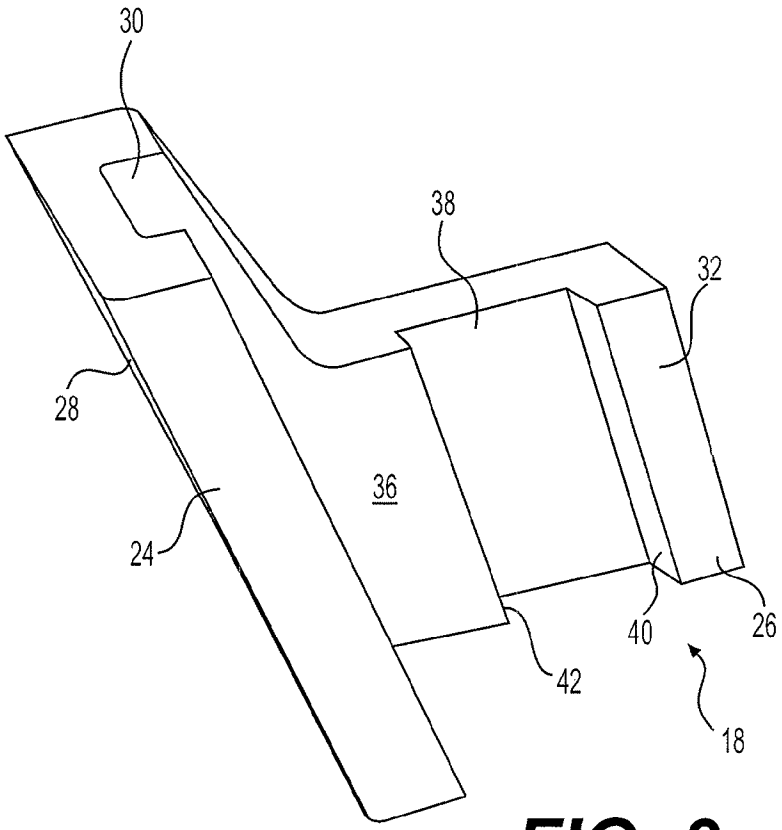
FIGS. 2-3 are illustrations of an exemplary wear member that may be used in conjunction with the work tool of FIG. 1.
Figure 2:
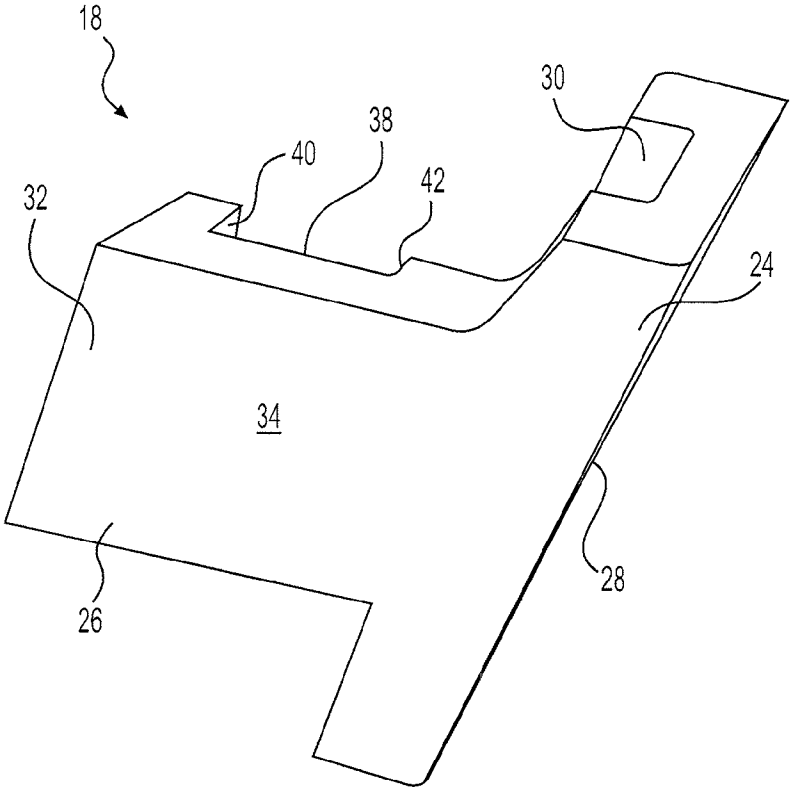

FIGS. 2-3 illustrate a side edge protector 18 in more detail. In an exemplary embodiment, side edge protector 18 may include a protector portion 24 configured to protect side edge 20 from wear and damage and a mounting portion 26 configured to secure side edge protector 18 to bucket 12. Side edge protector 18 may be formed from a strong, durable material such as steel, although other materials are possible.

In an exemplary embodiment, protector portion 24 may include a wear surface 28 and a receiving slot 30 disposed opposite wear surface 28. During use, protector portion 24 may be configured to contact the ground and other materials instead of side edge 20. Wear surface 28 may be configured to cover at least a portion of side edge 20. Wear surface 28 may take any shape, including straight, curved, round, etc. In some embodiments, wear surface 28 may form a cutting edge. Receiving slot 30 may be configured to receive side edge 20 to position protector portion 24 on bucket 12 and surround at least a portion of side edge 20. In some embodiments, receiving slot 30 may be sized and shaped to frictionally engage side edge 20, such as to temporarily hold side edge protector 18 in place while mounting portion 26 is secured to bucket 12.

In an exemplary embodiment, mounting portion 26 may be formed as a flange 32 extending from protector portion 24. Flange 32 may be attached to wear surface 28 and extend therefrom. Flange 32 may be integrally formed with wear surface 28 or may be a separate component secured to wear surface 28. Flange 32 may include an outer surface 34 and an inner surface 36. During use, outer surface 34 may be exposed as a wear surface, which may include any shape and/or configuration. Inner surface 36 may be configured to contact a side surface 22 of bucket 12 and be secured thereto. Inner surface 36 may at least partially define a mounting slot 38.

Mounting slot 38 may extend along an entire dimension (e.g., height) of flange 32, forming a pair of inner walls 40, 42. Mounting slot 38 may be formed as a recess in inner surface 36, such that inner surface 36 may be placed flush with side surface 22 of side edge 20. In one embodiment, mounting slot 38 may extend longitudinally in a direction substantially parallel to protector portion 24 and side edge 20 (e.g., when side edge protector 18 is mounted to bucket 12). Mounting slot 38 may be configured to receive a retention mechanism for securing mounting portion 26 to bucket 12.

In some embodiments, an additional slot 104 (shown only in FIGS. 13-14) may be formed in flange 32, the additional slot extending from a distal end of flange 32 (e.g., an end opposite protecting portion 24) to inner wall 40 and sized to receive a component of a retention mechanism (e.g., a mounting boss). As will be described, the additional slot may allow side edge protector 18 to be installed on side edge 20 from in front of side edge 20.

Figure 4:
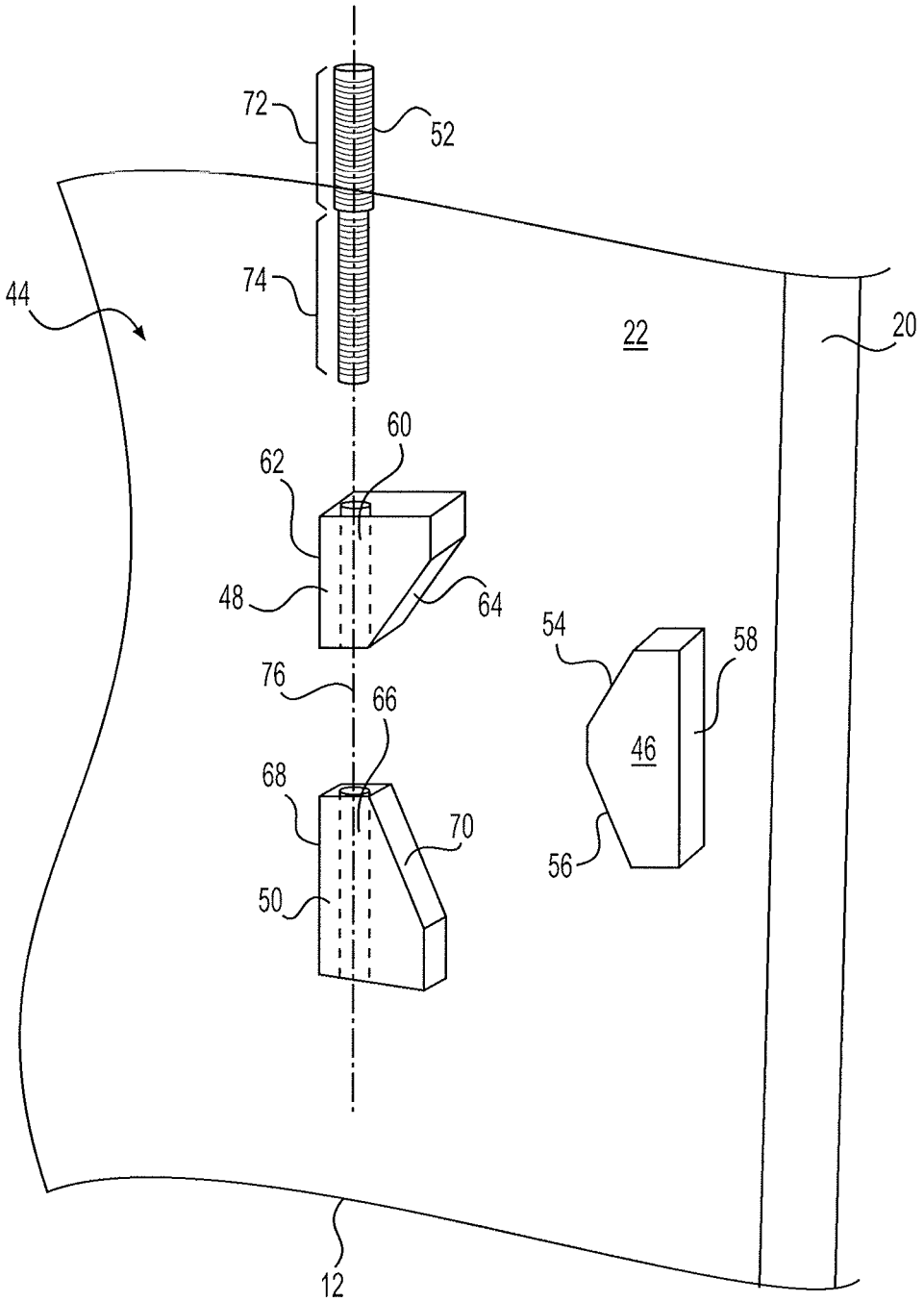
FIG. 4 is an exploded view of an exemplary retention mechanism that may be used to secure the wear member of FIGS. 2-3 to the work tool of FIG. 1.

FIG. 4 illustrates an exemplary retention mechanism 44. Retention mechanism 44 may include a plurality of components configured to secure mounting portion 26, and therefore side edge protector 18, to bucket 12. In an exemplary embodiment, retention mechanism 44 may include a mounting boss 46, a first retention member 48, a second retention member 50, and a fastener 52. These components of retention mechanism 44 may be configured to fit inside mounting slot 38 and be movable relative to each other to selectively secure mounting portion 26 to side surface 22.

Mounting boss 46 may be a protrusion-like component secured (e.g., permanently or removably attached) to bucket 12. In one embodiment, mounting boss 46 may be welded to side surface 22 of bucket 12. It should be understood, however, that mounting boss 46 may be secured to bucket 12 in any manner (e.g., threaded fasteners), or may be a protrusion that is integrally formed with side surface 22 of bucket 12. Mounting boss 46 may be shaped to include a plurality of engagement surfaces. In one embodiment, mounting boss 46 may have a dove-tail shape, including a first wedge engaging surface 54, a second wedge engaging surface 56, and a slot-engaging surface 58.

First and second wedge engaging surfaces 54, 56 may be formed as flat surfaces located on one side of mounting boss 46. Slot-engaging surface 58 may connect first and second wedge engaging surfaces 54, 56 at one end of mounting boss 46. In some embodiments, an additional flat surface may connect first and second wedge engaging surface 54, 56 at an opposite end of mounting boss 46. In other embodiments, first and second wedge engaging surfaces 54, 56 may meet at a point. As shown in FIG. 4, first and second wedge engaging surfaces may be angled with respect to each other, slot-engaging surface 58, and the vertical direction. As used herein, an "angle" refers to an angle that is greater than 0° and is formed within a plane.

In one embodiment, first and second wedge engaging surfaces 54, 56 may each form angles in the range of 0-45° with respect to the vertical direction, and which may be reflective angles (i.e., mirror images) with respect to the horizontal direction. As will be described, first and second wedge engaging surfaces 54, 56 may be configured to engage first retention member 48 and second retention member 50, respectively, to secure mounting portion 26 to side surface 22 of bucket 12.

Slot-engaging surface 58 may be formed as a flat surface located on another side of mounting boss 46, opposite first and second wedge engaging surfaces 54, 56. In one embodiment, slot-engaging surface 58 may be arranged parallel to the vertical direction. Slot-engaging surface 58 may be configured to engage mounting portion 26. For example, slot-engaging surface 58 may be configured to engage (e.g., abut and exert a retaining force on) inner wall 42 of mounting portion 26.

First retention member 48 may be a wedge-shaped component configured to engage mounting boss 46. In an exemplary embodiment, first retention member 48 may include a through hole 60, a slot-engaging surface 62, and a boss-engaging surface 64. In some embodiments, through hole 60 may be threaded. In other embodiments, however, through hole 60 may not be threaded. Slot-engaging surface 62 may be formed as a flat surface configured to engage (e.g., abut and exert a retaining force on) inner wall 40 of mounting slot 38. Boss-engaging surface 64 may be formed as a flat surface configured to engage (e.g., abut and exert a retaining force on) first wedge engaging surface 54 of mounting boss 46.

In an exemplary embodiment, boss-engaging surface 64 may be angled with respect to an axis of through hole 60 (which, in use, may be the vertical direction). For example, boss-engaging surface 64 may form an angle in the range of 1-45° with respect to an axis of through hole 60. In this way, a thickness of first retention member 48 (e.g., a dimension defined between slot-engaging surface 62 and boss-engaging surface 64) may gradually increase as first retention member 48 extends along the axis of through hole 60.

Second retention member 50 may be a wedge-shaped component also configured to engage mounting boss 46. In an exemplary embodiment, second retention member 50 may be substantially identical to first retention member 48. For example, second retention member 50 may be shaped substantially identically to first retention member 48, including a through hole 66, a slot-engaging surface 68, and a boss-engaging surface 70. Through hole 66 may or may not be threaded. In an exemplary embodiment through hole 66 may be threaded in an opposite direction compared to through hole 60 of first retention member 48. For example, through hole 60 may include right-handed threads while through hole 66 includes left-handed threads (or vice versa). In some embodiments, through holes 60, 66 may be different sizes (e.g., a diameter of through hole 60 being larger or smaller than a diameter of through hole 66).

Slot-engaging surface 68 may be formed as a flat surface configured to engage (e.g., abut and exert a retaining force on) inner wall 40. Boss-engaging surface 70 may be formed as a flat surface configured to engage (e.g., abut and exert a retaining force on) second wedge engaging surface 56 of mounting boss 46. In the embodiment in which second retention member 50 is substantially identical to first retention member 48, boss-engaging surface 70 may form the same angle with respect to the axis of through hole 66 as boss-engaging surface 64 forms with respect to the axis of through hole 60 (e.g., the same angle in the range of 1-45°). In other embodiments, first retention member 48 may not be substantially identical to second retention member 50, and boss-engaging surfaces 64, 70 may form different angles with respect to the axes of through holes 60, 66, respectively. In either instance, second retention member 50, like first retention member 48, may gradually increase in thickness (e.g., a dimension defined between slot-engaging surface 68 and boss-engaging surface 70) as second retention member 50 extends along the axis of through hole 66.

Fastener 52 may be a longitudinally-extending, cylindrical bolt configured to be received in through holes 60, 66. In one embodiment, fastener 52 may be a threaded fastener. For example, fastener 52 may include a first threaded section 72 and a second threaded section 74. In use, the longitudinal axes of fastener 52, through hole 60, and through hole 66 may be aligned along an axis 76 and inserted relative to each other such that first threaded section 72 is received by through hole 60 and second threaded section 74 is received by through hole 66.

In some embodiments, first threaded section 72 may include a different size than second threaded section 74. For example, a diameter of first threaded section 72 may be larger or smaller than a diameter of second threaded section 74, such as to match different diameter sizes of through holes 60 and 66. In this way, installation may be made easier by visually indicating which of first and second retention members 48, 50 mate with first threaded section 72 and second threaded section 74, respectively. Respective lengths of first threaded section 72 and second threaded section 74 may be generally the same. Fastener 52 may include a mechanism (e.g., recess, protrusion, etc.) allowing for rotation of fastener 52.

In some embodiments, first threaded section 72 and second threaded section 74 may be threaded in opposite directions. For example, first threaded section 72 may include right-handed threads, while second threaded section 74 includes left-handed threads (or vice versa). In this way, in an embodiment in which through holes 60, 66 are threaded in opposite directions (e.g., handedness), first threaded section 72 may mate with the threads of one of through holes 60, 66, and second threaded section 74 may mate with the threads of the other of through holes 60, 66. Thus, in use, rotation of fastener 52 while received in through holes 60, 66 causes first and second retention members 48, 50 to move in opposite directions along axis 76 (e.g., advance toward each other when fastener 52 is rotated in one direction and advance away from each other when fastener 52 is rotated in the opposite direction).

In other embodiments, fastener 52 may include alternative securing mechanisms (e.g., alternative to threads). For example, fastener 52 may include a plurality of snap grooves formed at longitudinally spaced locations of fastener 52. Fastener 52 may be placed in through holes 60, 66 and first and second retention members 48, 50 moved to a position that securely holds mounting portion 26 to bucket 12. One or more snap rings (not shown) may be positioned in corresponding snap grooves to hold first and second retention members 48, 50 in place. In some embodiments, fastener 52 may include a bolt head on one end, such that only one snap ring is needed to hold both first and second retention members 48, 50 in place.

While mounting boss 46, first retention member 48, second retention member 50, and fastener 52 are described herein as the components of retention mechanism 44, it should be understood that retention mechanism 44 may include one or more additional or alternative components. For example, in embodiments in which one or more of through holes 60, 66 are not threaded, a threaded nut may be included and configured to hold and advance first retention member 48 and/or second retention member 50 on fastener 52. It should be understood that other configurations of fastener 52 are also possible (e.g., a bolt with a head on one end and a threaded section on the other end, a fastener including a flexible portion for accommodating misalignment of through holes 60, 66, etc.). In an alternative embodiment, a fastener that is not threaded may be used in place of fastener 52. For example, a bar with grooves may be used (e.g., in conjunction with spacers and/or spring rings) to secure first and second retention members 48, 50 in place.

In another example, retention mechanism 44 may optionally include one or more dampening devices configured to absorb impact forces that occur during use of bucket 12. For example, a rubber pad may be secured to one or more of first wedge engaging surface 54, second wedge engaging surface 56, slot-engaging surface 58, boss-engaging surface 64, and boss-engaging surface 70. In this way, in use, forces translated between contacting surfaces of side edge protector 18, mounting boss 46, first retention member 48, and/or second retention member 50 may be dampened to help protect the associated components from damage. Retention mechanism may similarly include one or more spacers and/or spring-like mechanisms for increasing contact between adjacent surfaces.

Figure 6:
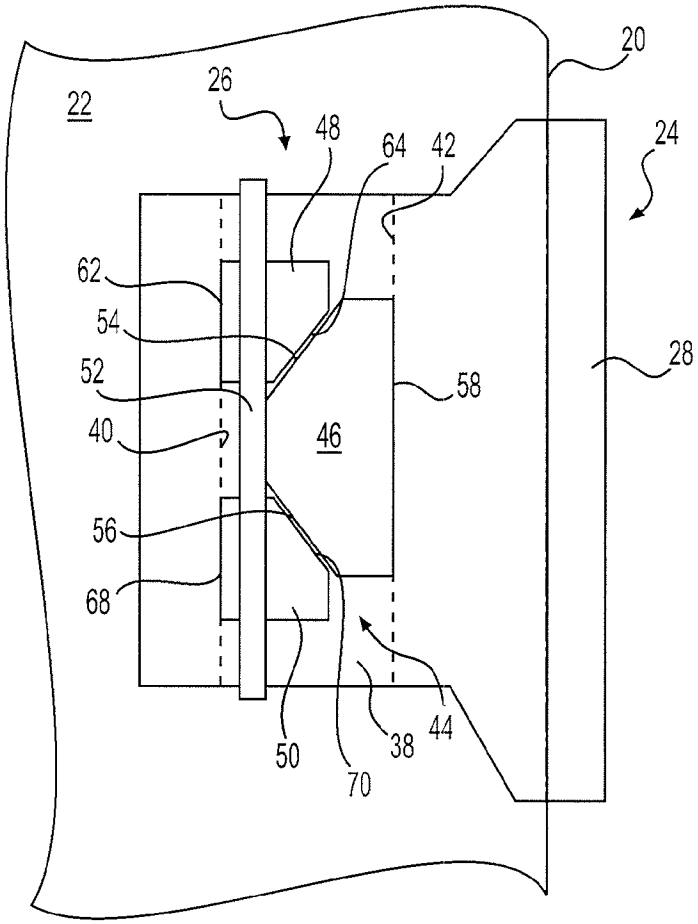
FIGS. 5-6 are cross-sectional views of the work tool assembly, depicted at different stages of installation.
Figure 5:
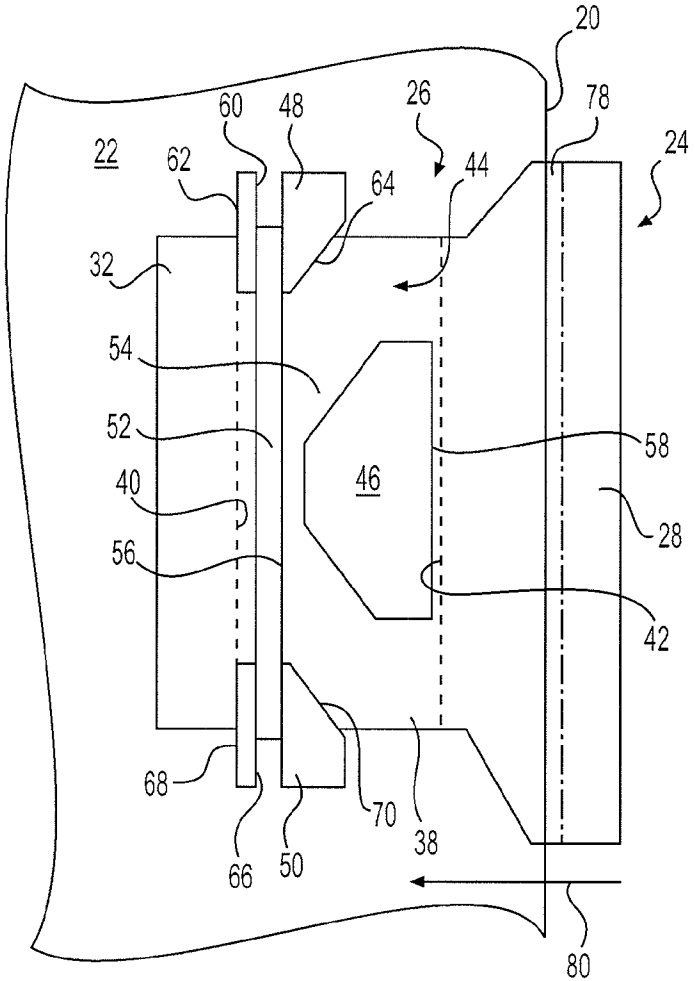

FIGS. 5-6 illustrate exemplary cross-sectional views inside mounting slot 38, depicting the manner in which retention mechanism 44 may be used to secure side edge protector 18 to bucket 12. FIG. 5 depicts side edge protector 18 initially positioned on side edge 20 of bucket 12, with mounting boss 46 located in mounting slot 38 and first retention member 48 and second retention member 50 located near opposite end portions of fastener 52. Fastener 52, with first and second retention members 48, 50, may be positioned inside mounting slot 38, adjacent the side of mounting boss 46 that includes first and second wedge engaging surfaces 54, 56. The longitudinal axis of fastener 52 may be oriented substantially parallel to the vertical direction, which in the disclosed embodiment is also parallel to side edge 20. As shown in FIG. 5, a gap 78 may initially exist between an inner surface of receiving slot 30 and side edge 20.

FIG. 6 depicts side edge protector 18 completely installed on side edge 20 of bucket 12, with retention mechanism 44 adjusted to produce a securing force that holds side edge protector 18 in place. First retention member 48 and second retention member 50 are positioned close to each other (as compared to the positions of FIG. 5), such that first wedge engaging surface 54 engages boss-engaging surface 64, second wedge engaging surface 56 engages boss-engaging surface 70, slot-engaging surface 58 engages inner wall 42, and slot-engaging surfaces 62, 68 engage inner wall 40. As shown in FIG. 6, side edge protector 18 has been pulled-back toward side edge 20, such that gap 78 no longer exists.

Figure 7:
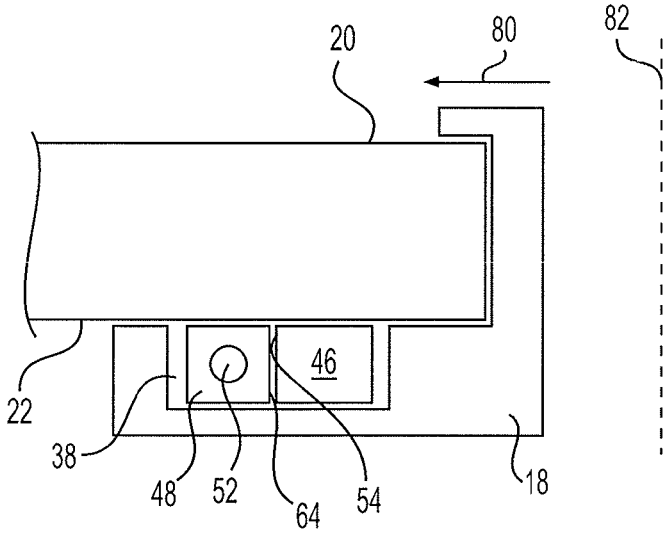
FIG. 7 is a top-view of the work tool assembly of FIGS. 5-6.

FIG. 7 illustrates a top-view of side edge protector 18 on side edge 20. As described above, as fastener 52 is tightened, side edge protector 18 is pulled in a direction of arrow 80, perpendicular to an axis 82, toward side edge 20. In this way, an inner surface of receiving slot 30 may firmly contact a surface of side edge 20, which may be a desired working position for side edge protector 18. In the embodiment of FIG. 7, first wedge engaging surface 54 and boss-engaging surface 64 may be angled with respect to axis 76 (as shown in FIG. 2) and may be generally parallel to axis 82 (as shown in FIG. 7).

Figure 8:
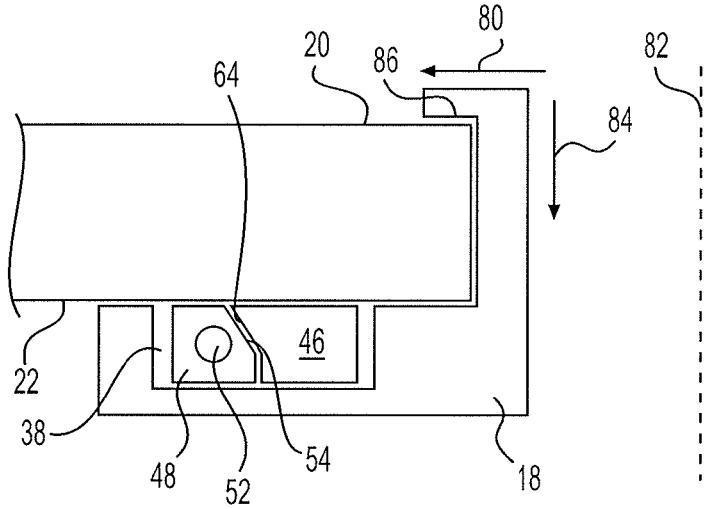
FIGS. 8-12 are top-views of the work tool assembly of FIGS. 5-6, according to alternative embodiments.
Figure 9:
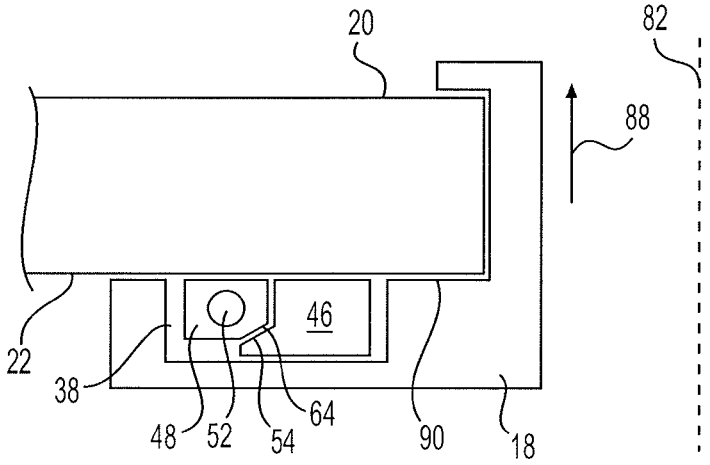

FIGS. 8-9 illustrates an alternative embodiment of mounting boss 46 and first retention member 48, in which at least a portion of first wedge engaging surface 54 and boss-engaging surface 64 are angled with respect to axis 82. In the embodiment of FIG. 8, at least a portion of first wedge engaging surface 54 and boss-engaging surface 64 are angled to form an acute angle with respect to axis 82. In the embodiment of FIG. 9, at least a portion of first wedge engaging surface 54 and boss-engaging surface 64 are angled to form an obtuse angle with respect to axis 82.

The additional angles formed by the embodiments of FIGS. 8 and 9 may allow for additional relative movement of side edge protector 18 while fastener 52 is tightened. For example, the acute angle formed in the embodiment of FIG. 8 may cause side edge protector to be pulled in a direction of arrow 84 along axis 82, such that an inner surface 86 of side edge protector 18 is pulled toward a corresponding side surface 22 of side edge 20. Similarly, the obtuse angle formed in the embodiment of FIG. 9 may cause side edge protector 18 to be pulled in a direction of arrow 88, opposite from the direction of arrow 84, such that an inner surface of 90 side edge protector 18 is pulled toward side surface 22 of side edge 20. First retention member 48 may be similarly pulled toward side surface 22, or toward an inner surface of mounting slot 38 that extends parallel to side surface 22, between side surface 22 and first retention member 48, that may be present in some alternative embodiments (not shown).

Figure 10:
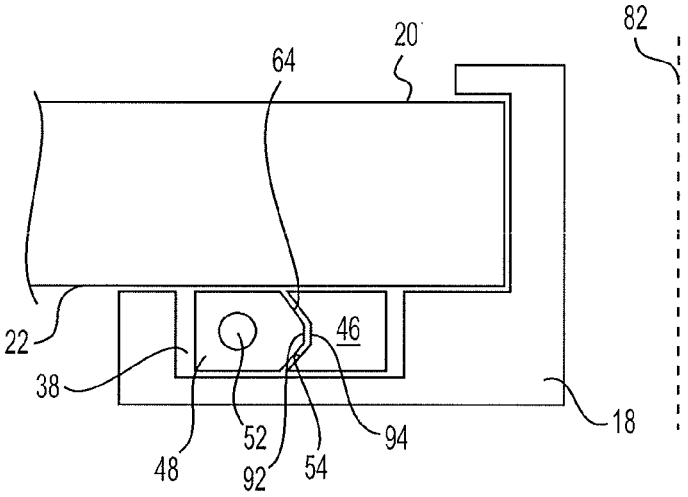

FIG. 10 illustrates another alternative embodiment of mounting boss 46 and first retention member 48, in which first wedge engaging surface 54 and boss-engaging surface 64 include mating features 92 and 94. As shown in FIG. 10, feature 92 may include a pair of converging surfaces that form a projection, and feature 94 may include a pair of diverging surfaces that form a recess. It should be understood, however, that mating features 92, 94 may include other configurations (e.g., projection on mounting boss 46 that mates with a recess in first wedge engaging surface 54). In use, mating features 92, 94 may increase a contact surface area between mounting boss 46 and first retention member 48, as well as to provide automatic centering of mounting boss 46 and first retention member 48.

Figure 11:
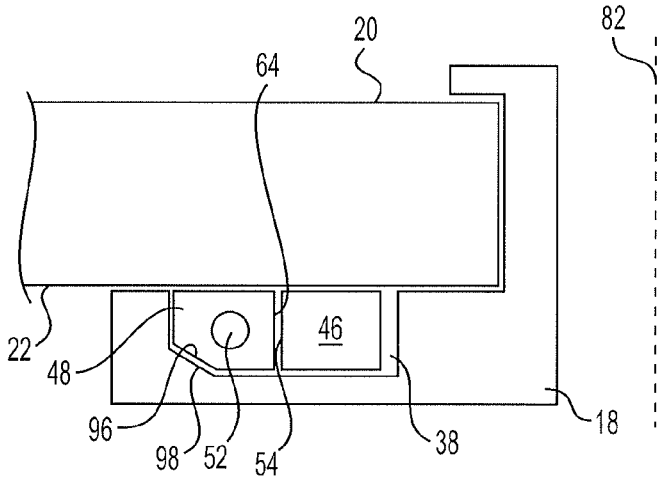
Figure 12:
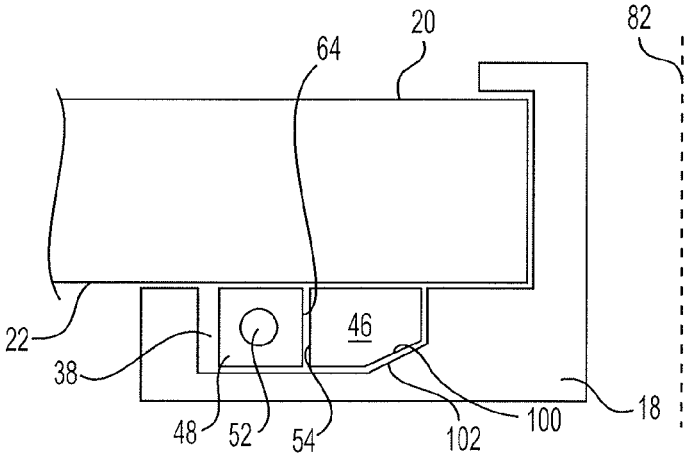

Further, in some embodiments, side edge protector 18 may include one or more surfaces that are angled to match an angled surface of mounting boss 46, first retention member 48, and/or second retention member 50. FIG. 11 illustrates an embodiment in which first retention member 48 includes a wall-engaging surface 96 that engages a wedge engaging surface 98 formed as part of inner wall 40. FIG. 12 illustrates an embodiment in mounting boss 46 includes a wall-engaging surface 100 that engages a wedge engaging surface 102 formed as part of inner wall 42. These corresponding surfaces may form angles with respect to a longitudinal direction of receiving slot 30 (e.g., axis 76) and/or a direction perpendicular to the longitudinal direction (e.g., axis 82), and provide additional contact surface area between mounting boss 46 and inner wall 42 and/or first retention member 48 and inner wall 40.

It should be understood that the embodiments of FIGS. 7-12 are exemplary, and that mounting boss 46, first retention member 48, and inner walls 40, 42 may take other configurations and/or shapes that also provide additional relative movement of side edge protector 18 during installation, increased contact surface area, automatic centering, and/or some other advantage. Further, it should be understood that second wedge engaging surface 56 and second retention member 50 may be similarly shaped to correspond to one of the described alternative embodiments of first wedge engaging surface 54 and first retention member 48 to provide the same effects described above.

In addition, it should be understood that some embodiments of retention mechanism 44 may include other configurations that provide the same effect of mounting a wear member (e.g., side edge protector 18) to a work tool (e.g., side edge 20 of bucket 12). For example, in some embodiments, mounting boss 46 may be shaped such that a sufficient retaining force may be generated by movement of only one retention member. In other embodiments, more than one mounting boss and/or more than two retention members may be provided, such as in an embodiment in which a side edge protector includes more than one mounting slot (or one mounting slot configured to receive more than one mounting boss).

Further in some embodiments, one or more components may be reversed. For example, mount 46 and first and second retention members 48, 50 may be shaped and arranged such that movement of first and second retention members 48, 50 away from each other along an axis (e.g., axis 76) may cause surfaces of first and second retention members 48, 50 to engage surfaces of mounting boss 46 and exert retaining forces within mounting slot 38.

Figure 14:
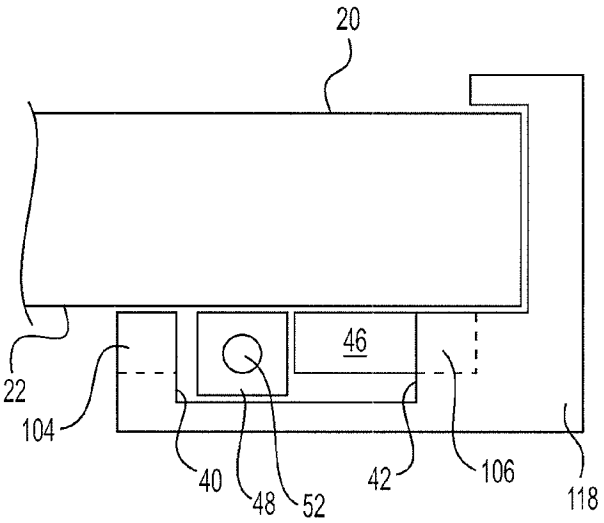
FIG. 14 is a top-view of the work tool assembly of FIG. 13.
Figure 13:
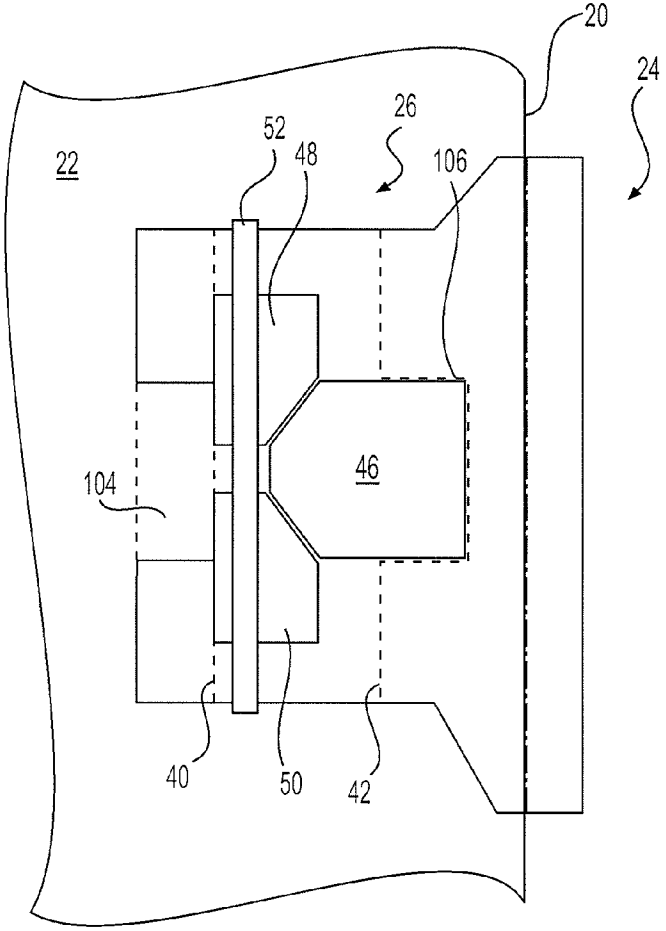
FIG. 13 is a cross-sectional view of an exemplary work tool assembly according to another embodiment.

FIGS. 13-14 illustrate another embodiment of a work tool assembly in which side edge protector 18 may be installed on side edge 20 in a fore/aft direction (e.g., from in front of side edge 20). Flange 32 may include a slot 104 connected and extending perpendicular to mounting slot 38. For example, slot 104 may extend from inner wall 40 to a distal end of flange 32. As shown in FIG. 13, slot 104 may be sized to receive mounting boss 46 therethrough. In this way, side edge protector may be installed in a fore/aft direction (e.g., in a direction of arrow 80), with flange 32 sliding such that mounting boss 46 is inserted through a distal opening of slot 104 and into mounting slot 38. In some embodiments, flange 32 may further include a positioning slot 106 configured to receive a portion of mounting boss 46 as flange 32 is moved into position. Positioning slot 106 may help maintain side edge protector 18 in position prior to installation of retention mechanism 44.

As shown in FIG. 14, mounting slot 104 may extend along only a portion of a width of inner wall 40. Therefore, at least a portion of inner wall 40 may extend along an entire height of mounting slot 38. In this way, first retention member 48 and second retention member 50 may exert a retaining force on inner wall 40 without interference from slot 104.

The disclosed embodiments include many possible configurations that allow one or more retaining forces to be generated based on movement of a retention member with respect to a mounting boss. Consistent with the disclosed embodiments, the one or more retaining forces may be applied in directions parallel to an axis that is perpendicular to an axis along which the retention member moves. An exemplary process for installing side edge protector 18 using retention mechanism 44 to apply these retaining forces is described in more detail below.

INDUSTRIAL APPLICABILITY

The disclosed retention system may be applicable to secure a wear member to a work tool. Further, the disclosed retention system allows a wear member to be pulled back onto the work tool (e.g., an edge of the work tool) during installation. For example, as the disclosed retention system is tightened, the components may produce a force that pulls the wear member toward the edge of the work tool being protected, thus allowing the wear member to stop in a variety of positions that may correspond to a working position (e.g., a position in which the wear member abuts the edge being protected). In this way, the disclosed retention system allows a wear member to adapt to size and shape variations associated with different work tools, such as those caused by wear, damage, manufacturing tolerances, etc. Further, since the retention system utilizes a fastener that is positioned parallel to the edge being protected, forces that are applied to the edge will be applied transversely to the fastener, helping to reduce the likelihood that the applied forces will cause the fastener to work loose. Further, the disclosed configuration of a mounting portion of the wear member allows the fastener to be disposed between the wear member and the work tool, and thus, less exposed to damage during use of the work tool. The disclosed retention system also allows a wear member to be installed without creating a hole in the work tool itself, thereby avoiding a negative effect on the strength and stability of the work tool.

In an exemplary embodiment, side edge protector 18 may be installed on side edge 20 of bucket 12 using retention mechanism 44. Side edge protector 18 may be initially positioned on side edge 20, as shown in FIG. 5. For example, side edge 20 may be received in receiving slot 30, and side edge protector 18 may slide relative to side edge 20 to allow mounting boss 46 to enter mounting slot 38. In some embodiments, an additional slot 104 extending from a distal edge of flange 32 to inner wall 40 may be sized to receive mounting boss 46 therethrough, thereby allowing side edge protector 18 to be installed horizontally onto side edge 20 from the front of side edge 20. In some embodiments, at least a portion of mounting boss 46 may be received in a positioning slot 106 (see FIGS. 13-14).

In some instances, after side edge protector 18 has been initially positioned with mounting boss in receiving slot 38, gap 78 may exist between side edge 20 and an inner surface of receiving slot 30, before retention mechanism 44 is tightened. Fastener 52 may be inserted into receiving slot 30, with first and second retention members 48, 50 placed on opposite ends of fastener 52 via through holes 60, 66.

With side edge protector 18 and the components of retention mechanism 44 in the position of FIG. 5, first and second retention members 48, 50 may be moved into engagement with mounting boss 46. For example, first and second retention members 48, 50 may be advanced toward each other until the position shown in FIG. 6 is reached. This movement along axis 76 may cause forces to be exerted on inner walls 40, 42, the forces oriented in opposite directions along an axis perpendicular to axis 76.

First and second retention members 48, 50 may be advanced toward each other by rotating fastener 52 (e.g., via a slot or protrusion on an end of fastener 52). In one embodiment, through hole 60 and first threaded section 72 may include first mating threads (e.g., right handed threads) and through hole 66 and second threaded section 74 may include second mating threads with handedness that is opposite from the first mating threads (e.g., left handed threads). In this way, rotation of fastener 52 in one direction may cause first and second retention members 48, 50 to move together in opposite directions (e.g., advance toward each other to the position of FIG. 6).

As first and second retention members 48, 50 advance toward each other, the surfaces thereof may come into contact with the surfaces of mounting slot 38 and mounting boss 46. For example, boss-engaging surfaces 64, 70 may slide along wedge engaging surfaces 54, 56, causing first and second retention members 48, 50 to move further into a space between mounting boss 46 and inner wall 40. As this occurs, retention members 48, 50 may exert a force on inner wall 40, pulling side edge protector 18 in a direction of arrow 80 (shown in FIG. 5). Side edge protector 18 may pull back onto side edge 20 until gap 78 is closed. At that time, first and second retention members 48, 50 may be wedged between mounting boss 46 and inner wall 40. In that position, first wedge engaging surface 54 engages boss-engaging surface 64, second wedge engaging surface 56 engages boss-engaging surface 70, slot-engaging surface 58 engages inner wall 42, and slot-engaging surfaces 62, 68 engage inner wall 40, thus creating an internal tension force on the inner walls 40, 42, and thus retaining side edge protector in place on side edge 20.

In some embodiments, one or more spacers, dampers, and/or spring-like members may be placed between contacting surfaces associated with side edge protector 18 and retention mechanism 44 (e.g., first engaging wedge surface 54 and mounting-boss-engaging surface 64, second wedge engaging surface 56 and boss-engaging surface 70, slot-engaging surface 58 and inner wall 42, slot-engaging surfaces 62, 68 and inner wall 40, side edge protector 18 and side edge 20, inner surface 36 and side surface 22, etc.). These elements may allow for additional adaptability of retention mechanism 44, allowing an increased retention force within mounting slot 38.

Further, in some embodiments (such as those described in FIGS. 7-12), one or more of the surfaces described herein may be angled with respect to additional directions to cause additional relative movement of side edge protector 18. For example, in some embodiments, first and second wedge engaging surfaces 54, 56 and/or mounting-boss engaging surfaces 64, 70 may form an angle with respect to an axis that is perpendicular to the axis of through holes 60, 66 (e.g., axis 82). Similarly, in some embodiments, one or more of inner walls 40, 42 may include a surface that forms an angle with respect to the longitudinal direction of receiving slot 38 and/or another axis (e.g., axis 82). In this way, retention mechanism 44 may be customized to cause side edge protector 18 to move in any of a plurality of directions during installation (e.g., receiving slot 30 pulled towards side edge 20, inner surface 36 pulled towards or away from side surface 22, etc.).

The disclosed retention mechanism 44 may allow side edge protector 18 to be installed on side edge 20 in an efficient and adaptable manner. In particular, retention mechanism 44 may allow for relative movement of side edge protector 18 during installation, allowing side edge protector 18 to be installed in a position that best fits side edge 20. Further, since retention mechanism 44 allows movement along an axis to exert forces in directions perpendicular to the axis, threaded member 52 may be positioned parallel to side edge 20, helping to prevent threaded member 52 from working loose during operation.

It will be apparent to those skilled in the art that various modifications and variations can be made to the disclosed retention mechanism. Other embodiments will be apparent to those skilled in the art from consideration of the specification and practice of the disclosed embodiments. For example, alternative retention mechanisms may include more or less components. For example, only one retention member may be used, or two retention mechanisms may be used to install one wear member. It is intended that the specification and examples be considered as exemplary only, with a true scope being indicated by the following claims and their equivalents.

What is claimed is:

1. A retention system for a wear member, comprising:

a flange configured to be attached to the wear member, the flange including a recessed mounting slot defined between a first inner wall and a second inner wall which are parallel to an axis;

a first retention member including a first surface and a first through hole;

a second retention member including a second surface and a second through hole; and a fastener including a first section configured to be received in the first through hole and a second section configured to be received in the second through hole, and configured to move the first retention member and the second retention member in opposite directions along the axis, wherein the retention system is configured such that movement of the first retention member and the second retention member in opposite directions along the axis causes the first surface and the second surface to exert a retaining force on the first inner wall in a direction perpendicular to the axis; and wherein the first through hole and the first section each include first threads that matingly engage each other, the second through hole and the second section each include second threads that matingly engage each other, and the first threads are threaded in a different direction than the second threads.

2. The retention system of claim 1, wherein the first retention member includes a third surface, wherein the third surface forms a first angle with respect to an axis of the first through hole and is configured to engage a mounting boss attached to the work tool.

3. The retention system of claim 2, wherein the second retention member includes a fourth surface, wherein the fourth surface forms a second angle with respect to an axis of the second through hole, and is configured to engage the mounting boss.

4. The retention system of claim 2, wherein the third surface forms a second angle with respect to an axis perpendicular to the axis of the first through hole.

5. The retention system of claim 1, further including a mounting boss configured to be attached to the work tool, the mounting boss including a third surface, and wherein the retention system is configured such that the movement of the first retention member and the second retention member in opposite directions along the axis causes the third surface to exert a retaining force on the second inner wall in an opposite direction perpendicular to the axis.

6. The retention system of claim 5, wherein the mounting boss includes a fourth surface, wherein the fourth surface forms a first angle with respect to the third surface, and is configured to engage the first retention member.

7. The retention system of claim 6, wherein the fourth surface forms a second angle with respect to an axis perpendicular to the first surface.

8. The retention system of claim 1, wherein at least one of the first inner wall and the second inner wall includes a surface that forms an angle with respect to the direction perpendicular to the axis.

9. A wear member assembly for a work tool, comprising:

a wear member including:

a protecting portion configured to protect an edge of the work tool, and a mounting portion configured to secure the wear member to a surface of the work tool, the mounting portion including a mounting slot defined between a first inner wall and a second inner wall which are parallel to an axis; and a retention mechanism configured to secure the mounting portion to the surface of the work tool, the retention mechanism including:

a retention member including a first surface and a first through hole; and a fastener including a first section configured to be received in the first through hole wherein the fastener includes a plurality of snap grooves configured to receive a snap ring, wherein the retention mechanism is configured such that movement of the first retention member along the axis causes the first surface to exert a retaining force on the first inner wall in a direction perpendicular to the axis.

10. The wear member of claim 9, wherein the protecting portion includes a receiving slot configured to receive the edge of the work tool.

11. The wear member of claim 10, wherein the retention mechanism is configured such that movement of the first retention member along the axis causes the receiving slot to move in the direction perpendicular to the axis.

12. The wear member of claim 10, wherein the retention mechanism is configured to secure the mounting portion to the surface with the receiving slot and the fastener positioned parallel to the axis.

13. The wear member of claim 10, wherein the mounting slot is formed as a recess on an inner surface of the mounting portion.

14. The wear member of claim 10, further including a second mounting slot extending perpendicular to the mounting slot between the first inner wall and an end of the mounting portion.

15. The wear member of claim 10, wherein:

the retention mechanism includes a second retention member including a second surface and a second through hole, the fastener includes a second section configured to be received in the second through hole, and is configured to move the first retention member and the second retention member in opposite directions along the axis, and the retention mechanism is configured such that the movement of the first retention member and the second retention member in opposite directions along the axis causes the second surface to exert a retaining force on the first inner wall.

16. The wear member of claim 15, wherein:

the retention mechanism includes a mounting boss including a third surface, and the retention mechanism is configured such that the movement of the first retention member and the second retention member in opposite directions along the axis causes the third surface to exert a retaining force on the second inner wall.

17. A work tool assembly, comprising:

a work tool including a side surface that extends to a side edge and a mounting boss secured to the side surface, the mounting boss including a first surface;

a wear member configured to be installed on the work tool, the wear member including:

a protecting portion configured to protect the edge of the work tool, and a mounting portion configured to secure the wear member to the side surface of the work tool, the mounting portion including a recessed mounting slot defined between a first inner wall and a second inner wall which are parallel to an axis; and a retention mechanism configured to secure the mounting portion to the side surface of the work tool, the retention mechanism including:

a first retention member including a second surface and a first through hole;

a second retention member including a third surface and a second through hole; and a fastener including a first section configured to be received in the first through hole and a second section configured to be received in the second through hole, and configured to move the first retention member and the second retention member in opposite directions along the axis wherein the first section includes a first diameter and the second section includes a second diameter, and the first diameter is different than the second diameter, wherein the retention mechanism is configured such that movement of the first retention member and the second retention member in opposite directions along the axis causes the second surface and the third surface to exert a retaining force on the first inner wall in a direction perpendicular to the axis, and the first surface to exert a retaining force on the second inner wall in an opposite direction perpendicular to the axis.

* * * * *